US007769330B2

(12) United States Patent
Kato et al.

(10) Patent No.: US 7,769,330 B2
(45) Date of Patent: Aug. 3, 2010

(54) IMAGE FORMING APPARATUS

(75) Inventors: Takayuki Kato, Kashiwa (JP); Hiroyuki Matsumoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 260 days.

(21) Appl. No.: 11/959,177

(22) Filed: Dec. 18, 2007

(65) Prior Publication Data

US 2008/0152400 A1 Jun. 26, 2008

(30) Foreign Application Priority Data

Dec. 21, 2006 (JP) ..... 2006-344270

(51) Int. Cl.
*G03G 15/01* (2006.01)

(52) U.S. Cl. ..... 399/302

(58) Field of Classification Search ..... 399/121, 399/299, 302, 308

See application file for complete search history.

(56) References Cited

U.S. PATENT DOCUMENTS

| | | | | |
|---|---|---|---|---|
| 6,269,231 | B1 | 7/2001 | Castelli et al. | |
| 6,898,407 | B2 | 5/2005 | Noguchi et al. | |
| 7,653,332 | B2 * | 1/2010 | Ehara et al. | 399/167 |
| 2003/0077091 | A1 | 4/2003 | Takahata et al. | |
| 2004/0126150 | A1 | 7/2004 | Noguchi et al. | |
| 2008/0240799 | A1 | 10/2008 | Noguchi et al. | |

FOREIGN PATENT DOCUMENTS

| | | |
|---|---|---|
| CN | 1493931 | 5/2004 |
| EP | 1383012 | 1/2004 |
| EP | 1431836 | 6/2004 |
| JP | 63-193168 | 8/1988 |
| JP | 10-254250 | 9/1998 |
| JP | 11-102124 | 4/1999 |
| JP | 2002-006573 | 1/2002 |
| JP | 2003-202728 | 7/2003 |
| JP | 2004-29057 | 1/2004 |
| JP | 2005-107436 | 4/2005 |

* cited by examiner

*Primary Examiner*—David M Gray
*Assistant Examiner*—Gregory H Curran
(74) *Attorney, Agent, or Firm*—Canon USA Inc IP Div

(57) ABSTRACT

An image forming apparatus includes an image forming unit, an image bearing belt, a first roller to support the image bearing belt, a second roller located away from the first roller in a horizontal direction in a lower place than the first roller to support and drive the image bearing belt, wherein the image bearing belt is inclined between the first roller and the second roller, a third roller located above the second roller to support the image bearing belt, wherein a plane of the image bearing belt formed between the second roller and the third roller is approximately vertical, a conveyance path configured to convey a recording material along the image bearing belt between the second roller and the third roller, and a transfer unit configured to transfer a toner image on the image bearing belt onto the recording material conveyed to the conveyance path.

4 Claims, 5 Drawing Sheets

IMAGE FORMING APPARATUS

BACKGROUND OF THE INVENTION

1. Field of the Invention

The present invention relates to an image forming apparatus which includes a belt that rotates while carrying a toner image. In particular, the present invention relates to an image forming apparatus that can stably rotate a belt.

2. Description of the Related Art

A conventional image forming apparatus which includes a belt that rotates while carrying a toner image is illustrated in FIG. 3. Recently, there are plural-color and full-color image forming apparatuses using an electrophotographic system in which a plurality of photosensitive drums is arranged in a single row for respective colors. Moreover, there is an in-line type image forming apparatus in which a toner image of each color that is formed on each photosensitive member drum is superimposed in order on an intermediate transfer belt to form a color image.

FIG. 3 illustrates a schematic view of an example of a full-color image forming apparatus (or a full-color printer) using a conventional electrophotographic system of an in-line type, which includes an intermediate transfer belt (or an intermediate transfer unit). Moreover, the image forming apparatus includes four image forming units (or image forming stations), i.e., an image forming unit 1Y for forming a yellow-color image, an image forming unit 1M for forming a magenta-color image, an image forming unit 1C for forming a cyan-color image, and an image forming unit 1Bk for forming a black-color image. The four image forming units are arranged in a single row at constant intervals.

Electrophotographic photosensitive members of a drum type (hereinafter referred to as photosensitive drums) 2*a*, 2*b*, 2*c* and 2*d* are disposed in the image forming units 1Y, 1M, 1C and 1Bk, respectively, as image carriers. Primary chargers 3*a*, 3*b*, 3*c* and 3*d*, development devices 4*a*, 4*b*, 4*c* and 4*d*, transfer rollers 5*a*, 5*b*, 5*c* and 5*d* serving as transfer units, and drum cleaning devices 6*a*, 6*b*, 6*c* and 6*d* are disposed surrounding the photosensitive drums 2*a*, 2*b*, 2*c* and 2*d*, respectively. A laser exposure device 7 is disposed below spaces between the primary chargers 3*a*, 3*b*, 3*c* and 3*d*, and the development devices 4*a*, 4*b*, 4*c* and 4*d*. The development devices 4*a*, 4*b*, 4*c* and 4*d* contain yellow toner, magenta toner, cyan toner, and black toner, respectively.

The photosensitive drums 2*a*, 2*b*, 2*c*, and 2*d* are negatively-charged organic photo conductor (OPC) photosensitive members, configured of an aluminum cylinder whose outer peripheral surface is coated with an organic photo conductive member layer. The photosensitive drums 2*a*, 2*b*, 2*c*, and 2*d* are rotated at a predetermined process speed in a direction of an arrow (in a clockwise direction illustrated in FIG. 3) by a driving device (not illustrated).

The primary chargers 3*a*, 3*b*, 3*c* and 3*d* are primary charging units. The primary chargers 3*a*, 3*b*, 3*c* and 3*d* uniformly charge the surfaces of the photosensitive drums 2*a*, 2*b*, 2*c*, and 2*d* to a negative polarity by a charging bias that is applied by a charging bias power source (not illustrated).

The development devices 4*a*, 4*b*, 4*c* and 4*d* contain toner and apply the respective color toner to an electrostatic latent image formed on each of the photosensitive drums 2*a*, 2*b*, 2*c*, and 2*d*. The electrostatic latent image is thus developed (visualized) as a toner image.

The transfer rollers 5*a*, 5*b*, 5*c* and 5*d*, which are primary transfer units, are in contact with the photosensitive drums 2*a*, 2*b*, 2*c* and 2*d* via the intermediate transfer belt 8 at primary transfer portions 32*a*, 32*b*, 32*c*, and 32*d*, respectively.

The drum cleaning devices 6*a*, 6*b*, 6*c* and 6*d* include cleaning blades that remove and collect residual primary transfer toner remaining on the photosensitive drums 2*a*, 2*b*, 2*c* and 2*d*, respectively.

The intermediate transfer belt 8 extends around a secondary transfer counter roller 10, a support roller 9, and a tension roller 11. The intermediate transfer belt 8 is rotated in the direction of an arrow A (a counterclockwise direction in FIG. 3) by a drive input to the secondary transfer counter roller 10. Consequently, the surface of the intermediate transfer belt 8 facing the primary transfer portions 32*a*, 32*b*, 32*c*, and 32*d* is pulled by the secondary transfer counter roller 10, to which a driving force is input. Thus, the intermediate transfer belt 8 can stably perform primary transfer.

The intermediate transfer belt 8 is formed by a dielectric resin, such as polycarbonate, polyethylene terephthalate resin film, or polyvinylidene-fluoride resin film. The secondary transfer counter roller 10 is in contact with a secondary transfer roller 12 via the intermediate transfer belt 8. Furthermore, a belt cleaning device 13, which removes and collects residual secondary transfer toner remaining on the intermediate transfer belt 8, is disposed outside the endless intermediate transfer belt 8 and near the tension roller 11.

Moreover, a fixing device 16, which includes a fixing roller 16*a* and a pressure roller 16*b*, is arranged downstream of the secondary transfer portion 34 relative to a conveyance direction of a transfer material P and above the secondary transfer portion 34. Thus, an approximately vertical conveyance path for conveying the transfer material P is formed.

The laser exposure device 7 includes a laser emitting unit, which emits a laser beam modulated according to a time-series electric digital pixel signal of image information, which is input to the laser exposure device 7. The laser exposure device 7 also includes a polygon lens and reflection mirrors. The laser exposure device 7 exposes the photosensitive drums 2*a*, 2*b*, 2*c* and 2*d*, which are charged by the primary chargers 3*a*, 3*b*, 3*c*, and 3*d*, to form latent images of respective colors according to image information.

Image forming operation by the above-described image forming apparatus will be described below.

Upon generation of a signal to start an image forming operation, the primary chargers 3*a*, 3*b*, 3*c* and 3*d* uniformly charge the photosensitive drums 2*a*, 2*b*, 2*c* and 2*d*, which are rotated at a predetermined process speed, in the image forming units 1Y, 1M, 1C and 1Bk to a negative polarity, respectively.

A laser diode in the laser exposure device 7 emits a laser beam based on color-separated image signals that are input externally. Consequently, the emitted laser beam forms a latent image corresponding to each color on the photosensitive drums 2*a*, 2*b*, 2*c* and 2*d* via the polygon lens and reflection mirrors.

A developing bias of the same polarity as the charging polarity (i.e., negative polarity) of the photosensitive drum 2*a* is applied to the development device 4*a*. The development device 4*a* then applies yellow toner to the latent image formed on the photosensitive drum 2*a*. The electrostatic latent image is thus visualized as a toner image. A primary transfer bias, whose polarity is opposite that of the toner, i.e., a positive polarity, is applied on the transfer roller 5*a*. The transfer roller 5*a* then primarily transfers the obtained yellow toner image on the photosensitive drum 2*a* onto the rotating intermediate transfer belt 8 at the primary transfer portion 32*a* between the photosensitive drum 2*a* and the transfer roller 5*a*. The intermediate transfer belt 8, onto which the yellow toner image is transferred, is moved towards the image forming unit 1M.

In the image forming unit 1M, a magenta toner image formed on the photosensitive drum 2*b* similarly as the above-described yellow toner image is transferred to the intermediate transfer belt 8 at the primary transfer portion 32*b*. The magenta toner image is superimposed on the yellow toner image on the intermediate transfer belt 8.

Further, cyan and black toner images are formed on the photosensitive drums 2*c* and 2*d* in the image forming units 1C and 1Bk. The cyan and black toner images are then similarly sequentially superimposed on the yellow and magenta toner images transferred onto the intermediate transfer belt 8 at the primary transfer portions 32*c* and 32*d*, respectively. A full-color toner image is thus formed on the intermediate transfer belt 8.

Cleaning blades in each of the drum cleaning devices 6*a*, 6*b*, 6*c* and 6*d* remove and collect residual primary transfer toner remaining on the respective photosensitive drums 2*a*, 2*b*, 2*c* and 2*d*.

The transfer material P is selected from a sheet cassette 17 or a manual feed tray 20. A registration roller 19 then conveys the transfer material P to the secondary transfer portion 34 between the secondary transfer counter roller 10 and the secondary transfer roller 12 via a conveyance path 18. The transfer material P is conveyed to the secondary transfer portion 34 in synchronization with timing in which a leading end of the full-color toner image on the intermediate transfer belt 8 is moved to the secondary transfer portion 34.

A secondary transfer bias, whose polarity is opposite that of the toner, i.e., a positive polarity, is applied to the secondary transfer roller 12. The secondary transfer roller 12 collectively secondarily transfers the full-color toner image onto the transfer material P.

The transfer material P, on which the full-color toner image is formed, is conveyed to the fixing device 16. The full-color toner image is heated and pressed by the fixing nip portion between the fixing roller 16*a* and the pressure roller 16*b*. Then, the toner image is heat-fused on the surface of the transfer material P. A discharge roller 21 discharges the transfer material P onto a discharge tray 22 on the upper surface of the image forming apparatus, and the series of image forming operations ends. The belt cleaning device 13 removes and collects residual secondary transfer toner remaining on the intermediate transfer belt 8.

FIG. 4 illustrates an enlarged configuration of an area around the secondary transfer portion 34. As described above, the transfer material P that is conveyed by the registration roller 19 enters the secondary transfer portion 34 through a path represented by a chain double-dashed line in FIG. 4. The intermediate transfer belt 8, carrying the full-color toner image, and the transfer material P are away from each other at an angle $\alpha$ just before the transfer material P reaches the secondary transfer portion 34, as illustrated in FIG. 4. Since the transfer material P rapidly comes close to the intermediate transfer belt 8 at the secondary transfer portion 34, an image defect may occur due to a discharge phenomenon. To prevent such an image defect, in recent image forming apparatuses, a driven support roller 9 is additionally disposed upstream of the secondary transfer portion 34 relative to the intermediate transfer belt 8, as illustrated in FIG. 5. A secondary transfer plane 8*c* is thus formed by the secondary transfer counter roller 10 and the driven support roller 9, and the transfer material P is conveyed along the secondary transfer plane 8C.

By conveying the transfer material P along the secondary transfer plane 8*c*, the direction of the transfer material P entering the secondary transfer portion 34 and the traveling direction of the intermediate transfer belt 8 carrying the toner image can approximately match each other. As a result, the above-described discharge phenomenon just before the secondary transfer portion 34 can be reduced, and an image defect can be prevented. In this configuration, the intermediate transfer belt 8 extends around the secondary transfer counter roller 10, the driven support roller 9, and the tension roller 11. The intermediate transfer belt 8 is rotated in the direction of the arrow A (i.e., counterclockwise direction in FIG. 5) by a drive input to the secondary transfer counter roller 10.

However, a stable rotation of the intermediate transfer belt 8 is required to meet the recent demand for high image quality. Therefore, a wrapping angle of the intermediate transfer belt 8 around the secondary transfer counter roller 10 needs to be increased in order to increase friction transmission from the secondary transfer counter roller 10 to the intermediate transfer belt 8.

However, when the driven support roller 9 is added upstream of the secondary transfer portion 34 relative to the intermediate transfer belt 8, as illustrated in FIG. 5, the wrapping angle of the intermediate transfer belt 8 around the secondary transfer counter roller 10 becomes small.

To overcome such a problem, there are two solutions as below:

1. Incline the secondary transfer plane 8*c* at an angle with respect to the apparatus main body from a vertical position; and
2. Increase the diameter of the secondary transfer counter roller 10.

However, new problems arise in each of the above methods.

In the first method, the secondary transfer plane 8*c* is inclined at an angle with respect to the apparatus main body from a vertical position. Consequently, the transfer material conveyance path from the registration roller 19 to the discharge roller 21 via the secondary transfer portion 34 and the fixing device 16 is greatly inflected. In such a case, the conveyed transfer material P is discharged rightward from the secondary transfer portion 34 as illustrated in FIG. 5. The transfer material P is then bent leftward by the fixing device 16 as illustrated in FIG. 5 and conveyed to the discharge roller 21. Since the form of the transfer material P just after passing through the secondary transfer portion 34 has an effect on an unfixed toner image formed on the transfer material P, the form of the transfer material P is required to be stable.

Recently, a wide variety of transfer materials is used in an image forming apparatus, and images are formed on various transfer materials of grammage of less than 60 g/m$^2$, up to 300 g/m$^2$, and from thin to thick papers. If the above-described bend is too large, the form of the transfer material P just after being discharged from the secondary transfer portion 34 cannot be stably maintained. Therefore, a problem arises when the image forming apparatus accepts such various types of transfer materials.

On the other hand, if the diameter of the secondary transfer counter roller 10 is increased as in the second method, the transfer material P may twine around the secondary transfer counter roller 10. That is, as described above, the toner image on the intermediate transfer belt 8 is transferred onto the transfer material P by applying a secondary transfer bias at the secondary transfer portion 34. Consequently, the transfer material P is attracted to the intermediate transfer belt 8 by the generated electrostatic force. If the diameter of the secondary transfer roller 10 is large, it is difficult for the transfer material P to separate from the secondary transfer roller 10 owing to the stiffness of the transfer material P. As a result, the transfer material P may twine around the secondary transfer counter roller 10.

Thus, although the transferability of the transfer material P can be improved by disposing an additional roller upstream of the secondary transfer portion 34 to form a secondary transfer plane that is approximately vertical, the friction transmission from the secondary transfer counter roller 10 to the intermediate transfer belt 8 becomes insufficient.

SUMMARY OF THE INVENTION

According to an aspect of the present invention, an image forming apparatus includes an image forming unit configured to form a toner image, an image bearing belt configured to allow the toner image to be formed thereon by the image forming unit, a first roller configured to support the image bearing belt, a second roller located away from the first roller in a horizontal direction in a lower place than the first roller and configured to drive the image bearing belt while supporting the image bearing belt, wherein the toner image is formed on the image bearing belt, which is inclined between the first roller and the second roller, a third roller located above the second roller and configured to support the image bearing belt, wherein a plane of the image bearing belt formed between the second roller and the third roller is approximately vertical, a conveyance path configured to convey a recording material along the image bearing belt between the second roller and the third roller, and a transfer unit configured to form an electric field between the transfer unit and the third roller and to transfer the toner image on the image bearing belt onto the recording material conveyed to the conveyance path.

An image forming apparatus embodying the present invention is capable of stably rotating an intermediate transfer belt in a configuration in which a roller is located upstream of a secondary transfer portion to form a secondary transfer plane.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
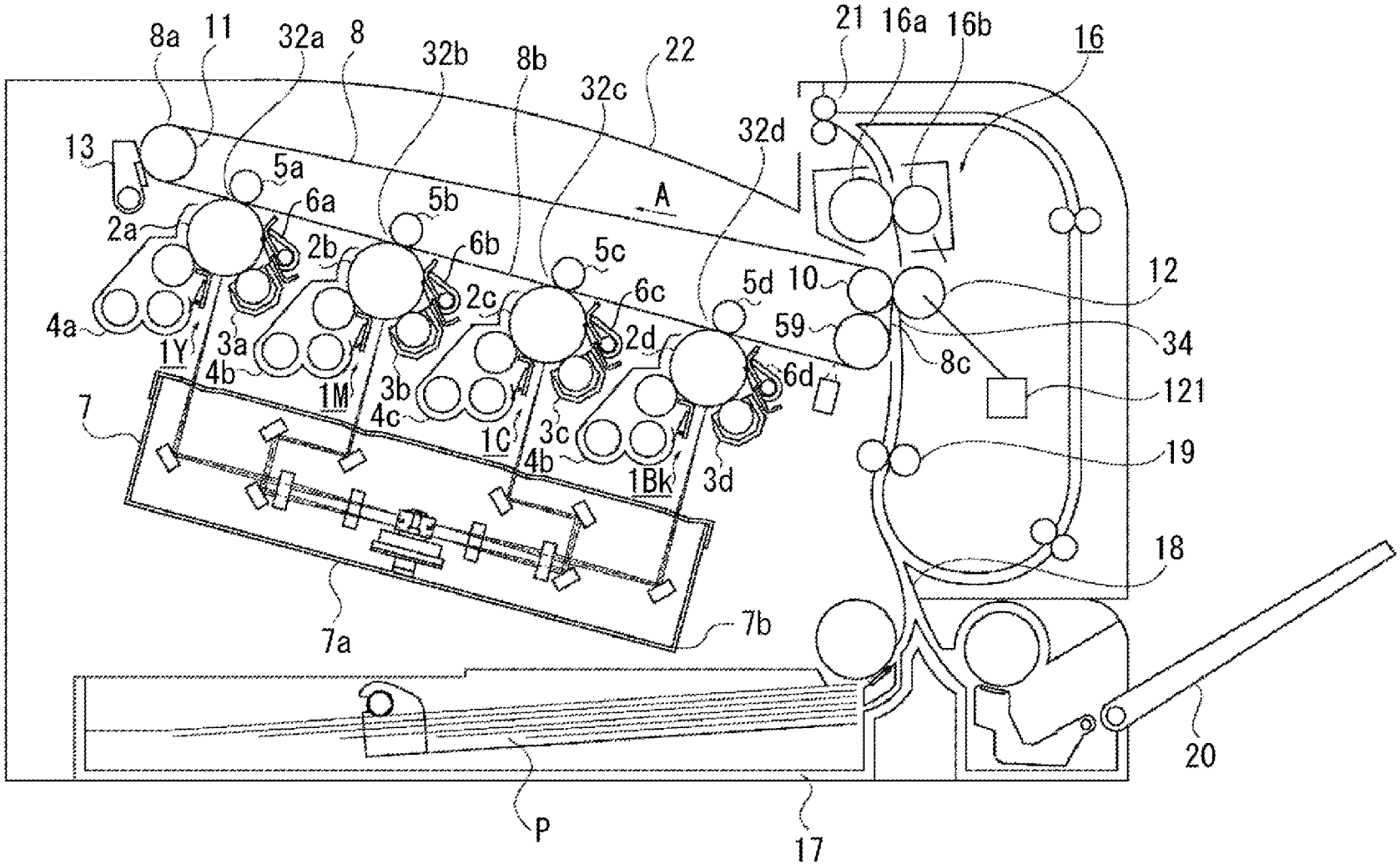
FIG. 1 illustrates a configuration of an image forming apparatus according to an exemplary embodiment of the present invention.

FIG. 1 illustrates a configuration of an example of a full-color image forming apparatus (or a full-color printer) using an electrophotographic system of an in-line type. The full-color image forming apparatus includes an intermediate transfer belt (or an image carrying belt).

The image forming apparatus includes an image forming unit 1Y for forming a yellow-color image, an image forming unit 1M for forming a magenta-color image, an image forming unit 1C for forming a cyan-color image, and an image forming unit 1Bk for forming a black-color image. The four image forming units 1Y, 1M, 1C, and 1Bk are arranged in a single row at constant intervals.

Electrophotographic photosensitive members of a drum type (hereinafter referred to as photosensitive drums) 2*a*, 2*b*, 2*c* and 2*d* are disposed in the image forming portions 1Y, 1M, 1C and 1Bk, respectively, as image carriers. Primary chargers 3*a*, 3*b*, 3*c* and 3*d*, development devices 4*a*, 4*b*, 4*c* and 4*d*, transfer rollers 5*a*, 5*b*, 5*c* and 5*d* serving as transfer units, and drum cleaning devices 6*a*, 6*b*, 6*c* and 6*d* are disposed surrounding the photosensitive drums 2*a*, 2*b*, 2*c* and 2*d*, respectively. A laser exposure device 7 is disposed below a space between the primary chargers 3*a*, 3*b*, 3*c* and 3*d*, and the development devices 4*a*, 4*b*, 4*c* and 4*d*, respectively.

The development devices 4*a*, 4*b*, 4*c* and 4*d* contain yellow toner, magenta toner, cyan toner, and black toner, respectively.

The photosensitive drums 2*a*, 2*b*, 2*c*, and 2*d* are negatively-charged organic photo conductor (OPC) photosensitive members, configured of an aluminum cylinder whose outer peripheral surface is coated with an organic photo conductive member layer. The photosensitive drums 2*a*, 2*b*, 2*c*, and 2*d* are rotated at a predetermined process speed in a direction of an arrow (in a clockwise direction illustrated in FIG. 1) by a driving device (not illustrated).

The primary chargers 3*a*, 3*b*, 3*c* and 3*d* uniformly charge the surfaces of the photosensitive drums 2*a*, 2*b*, 2*c*, and 2*d* to a negative polarity by a charging bias that is applied by a charging bias power source (not illustrated).

The development devices 4*a*, 4*b*, 4*c* and 4*d* contain toner, and apply the respective color toner to an electrostatic latent image formed on each of the photosensitive drums 2*a*, 2*b*, 2*c*, and 2*d*. The electrostatic latent image is thus developed (visualized) as a toner image.

The transfer rollers 5*a*, 5*b*, 5*c* and 5*d* are in contact with the photosensitive drums 2*a*, 2*b*, 2*c* and 2*d* via the intermediate transfer belt 8 at the primary transfer portions 32*a*, 32*b*, 32*c*, and 32*d*, respectively. The drum cleaning devices 6*a*, 6*b*, 6*c* and 6*d* include cleaning blades that remove and collect residual primary transfer toner remaining on the photosensitive drums 2*a*, 2*b*, 2*c* and 2*d*, respectively.

The intermediate transfer belt 8 extends around a secondary transfer counter roller (third roller) 10, a driving roller (second roller) 59, and a tension roller (first roller) 11. Consequently, the intermediate transfer belt 8 is rotated in a direction of an arrow A (a clockwise direction in FIG. 1) by a drive input to the driving roller 59. The intermediate transfer belt 8 is formed by a dielectric resin, such as polycarbonate, polyethylene terephthalate resin film, or polyvinylidene-fluoride resin film. The secondary transfer counter roller 10 is in contact with a secondary transfer roller 12 via the intermediate transfer belt 8 at a secondary transfer portion 34. Further, a belt cleaning device 13, which removes and collects residual secondary transfer toner remaining on the intermediate transfer belt 8, is disposed outside the intermediate transfer belt 8 near the tension roller 11.

Moreover, a fixing device 16, which includes a fixing roller 16*a* and a pressure roller 16*b*, is arranged downstream of the secondary transfer portion 34 relative to a conveyance direction of a transfer material P and above the secondary transfer portion 34. Thus, an approximately vertical conveyance path for conveying the transfer material P is formed.

The laser exposure device 7 includes a laser emitting unit, which emits a laser beam modulated according to a time-series electric digital pixel signal of image information, which is input to the laser exposure device 7. The laser exposure device 7 also includes a polygon lens and reflection mirrors. The laser exposure device 7 exposes the photosensitive drums 2*a*, 2*b*, 2*c* and 2*d*, which are charged by the primary chargers 3*a*, 3*b*, 3*c*, and 3*d*, to form latent images of respective colors according to image information.

Image forming operation by the above-described image forming apparatus will be described below.

Upon generation of a signal to start an image forming operation, the photosensitive drums 2*a*, 2*b*, 2*c* and 2*d*, which are rotated at a predetermined process speed, in the image forming units 1Y, 1M, 1C and 1Bk are uniformly charged to a negative polarity by the primary chargers 3*a*, 3*b*, 3*c* and 3*d*, respectively.

A laser diode in the laser exposure device 7 emits a laser beam based on color-separated image signals that are input externally. Consequently, the emitted laser beam forms a latent image corresponding to each color on the photosensitive drums 2*a*, 2*b*, 2*c* and 2*d* via the polygon lens and reflection mirrors.

A developing bias of the same polarity as the charging polarity (i.e., negative polarity) of the photosensitive drum 2*a* is applied to the development device 4*a*. The development device 4*a* then applies yellow toner to the latent image formed on the photosensitive drum 2*a*. The electrostatic latent image is thus visualized as a toner image. A primary transfer bias, whose polarity is opposite that of the toner, i.e., a positive polarity, is applied to the transfer roller 5*a*. The transfer roller 5*a* then primarily transfers the obtained yellow toner image on the photosensitive drum 2*a* onto the rotating intermediate transfer belt 8 at the primary transfer portion 32*a* between the photosensitive drum 2*a* and the transfer roller 5*a*. The intermediate transfer belt 8, onto which the yellow toner image is transferred, is moved towards the image forming unit 1M.

In the image forming unit 1M, a magenta toner image formed on the photosensitive drum 2*b* similarly as the above-described yellow toner image is transferred to the intermediate transfer belt 8 at the primary transfer portion 32*b*. The magenta toner image is superimposed on the yellow toner image on the intermediate transfer belt 8.

Further, cyan and black toner images are formed on the photosensitive drums 2*c* and 2*d* in the image forming units 1C and 1Bk. The cyan and black toner images are then similarly sequentially superimposed on the yellow and magenta toner images transferred onto the intermediate transfer belt 8 at the primary transfer portions 32*c* and 32*d*, respectively. A full-color toner image is thus formed on the intermediate transfer belt 8.

Cleaning blades in each of the drum cleaning devices 6*a*, 6*b*, 6*c* and 6*d* remove and collect residual primary transfer toner remaining on the respective photosensitive drums 2*a*, 2*b*, 2*c* and 2*d*.

The transfer material (or recording material) P is selected from a sheet cassette 17 or a manual feed tray 20. A registration roller 19 then conveys the transfer material P to the secondary transfer portion 34 between the secondary transfer counter roller 10 and the secondary transfer roller 12 via a conveyance path 18. The transfer material P is conveyed to the secondary transfer portion 34 in synchronization with timing in which a leading end of the full-color toner image on the intermediate transfer belt 8 is moved to the secondary transfer portion 34.

A power source 121 applies a secondary transfer bias, whose polarity is opposite that of the toner, i.e., a positive polarity, to the secondary transfer roller 12. The secondary transfer roller 12 then collectively secondarily transfers the full-color toner image onto the transfer material P. An electric field is formed between the secondary transfer counter roller 10 and the secondary transfer roller 12 during secondary transfer, so that the toner image is transferred to the transfer material P by an electrostatic force generated from the electric field.

The transfer material P is conveyed from the registration roller 19 to the secondary transfer portion 34 along a secondary transfer plane 8*c*, which is formed by the driving roller 59 and the secondary transfer counter roller 10. Accordingly, an image defect, which may be generated by a discharging phenomenon occurring just before the transfer material P enters the secondary transfer portion 34, can be prevented or reduced. Moreover, the secondary transfer plane 8*c* is formed directly downstream of the driving roller 59 (i.e., on the slack side of the intermediate transfer belt 8). However, since a drive is input to the secondary transfer roller 12, the secondary transfer roller 12 rotates independent of the intermediate transfer belt 8. Therefore, the secondary transfer plane 8*c* can form a dynamically stable plane.

The transfer material P, on which the full-color toner image is formed, is then conveyed to the fixing device 16. The full-color toner image is heated and pressed by the fixing nip portion between the fixing roller 16*a* and the pressure roller 16*b*. Then, the toner image is heat-fused on the surface of the transfer material P. The transfer material P is then discharged onto a discharge tray 22 on the upper surface of the image forming apparatus by the discharge roller 21, and the series of image forming operations ends. The belt cleaning device 13 removes and collects residual secondary transfer toner remaining on the intermediate transfer belt 8.

Moreover, in the present exemplary embodiment, a primary transfer plane 8*b* is formed at a slant to the horizontal direction. Further, the driving roller 59 is in a lower place than the tension roller 11. As a result, a wrapping angle β (illustrated in FIG. 2) of the intermediate transfer belt 8 around the driving roller 59 increases, thus stabilizing the rotation of the intermediate transfer belt 8.

Furthermore, the image forming apparatus can be downsized in both the height and width directions. That is, the primary transfer portion 32*d* of the image forming unit 1Bk is located in a lower place than the primary transfer portion 32*a* of the image forming unit 1Y. Thus, the distance between the photosensitive drum 2*d* and the sheet cassette 17 can be shortened by inclining the primary transfer plane 8*b*. Consequently, since the secondary transfer portion 34 is relatively located in a lower place, the total distance for conveying the transfer material P from the sheet cassette 17 to the discharge roller 21 via the secondary transfer portion 34 and the fixing device 16 is shortened. As a result, the image forming apparatus can be downsized in the height direction, at least in the region including the transfer-material path from the cassette 17 to the discharge roller 21. Additionally, the position of the tension roller 11, around which the intermediate transfer belt 8 extends, is at the left-most extremity of the image forming apparatus. By inclining the primary transfer plane 8*b*, the tension roller 11 is relatively moved to the right, so that the width of the image forming apparatus can be reduced. However, if the primary transfer plane 8*b* is excessively inclined, since the tension roller 11 defines the height of the image forming apparatus, the height of the image forming apparatus on the left-hand side will increase. Therefore, it is useful to incline the primary transfer plane by 10 to 25 degrees.

Conveyance of the leading edge of the transfer material P in the secondary transfer portion 34 will be described below. At the secondary transfer portion 34, the toner image on the intermediate transfer belt 8 is transferred to the transfer material P by applying a secondary transfer bias. However, an electrostatic force generated by the above process attracts the transfer material P to the intermediate transfer belt 8. Consequently, the transfer material P may twine around the secondary transfer counter roller 10. To solve such a problem, in the configuration illustrated in FIG. 1, the outside diameter of the secondary transfer counter roller 10 is set sufficiently small to increase the curvature. Therefore, the transfer material P can be steadily separated from the intermediate transfer belt 8.

Figure 2:
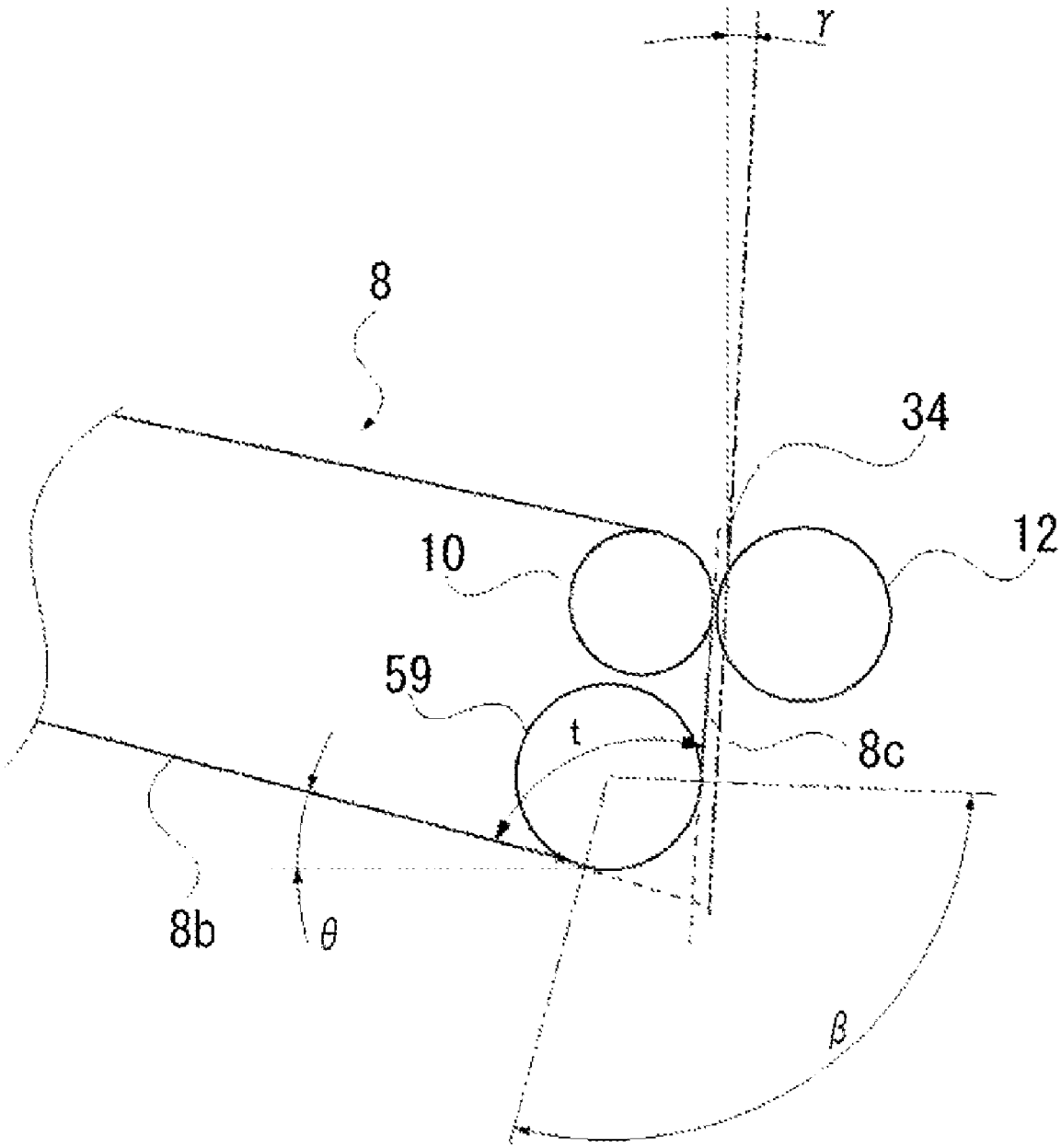
FIG. 2 illustrates an enlarged view of an area around a secondary transfer portion according to an exemplary embodiment in the present invention.
Figure 3:
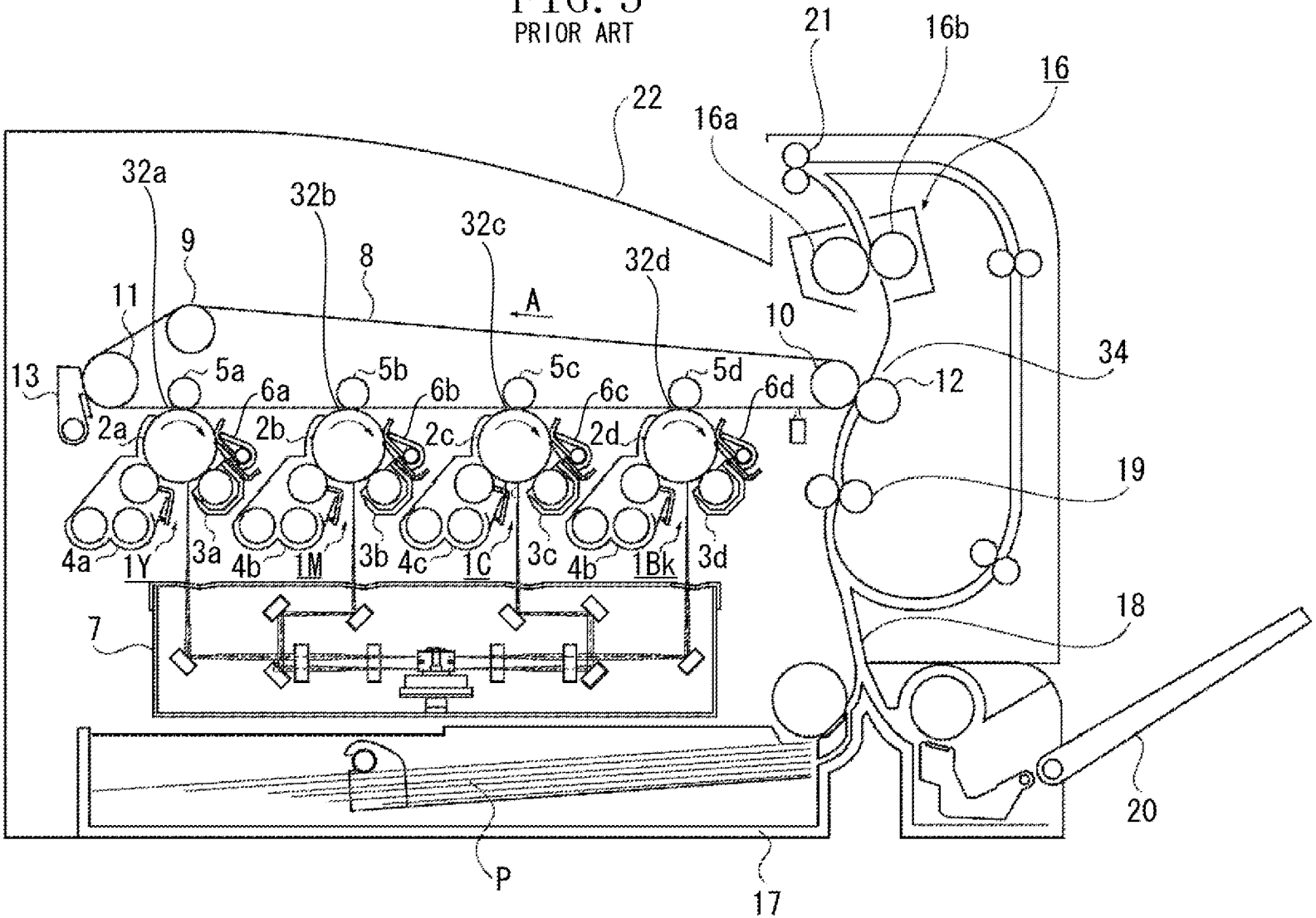
FIG. 3 PRIOR ART
FIG. 3 illustrates a configuration of a conventional image forming apparatus.
Figure 4:
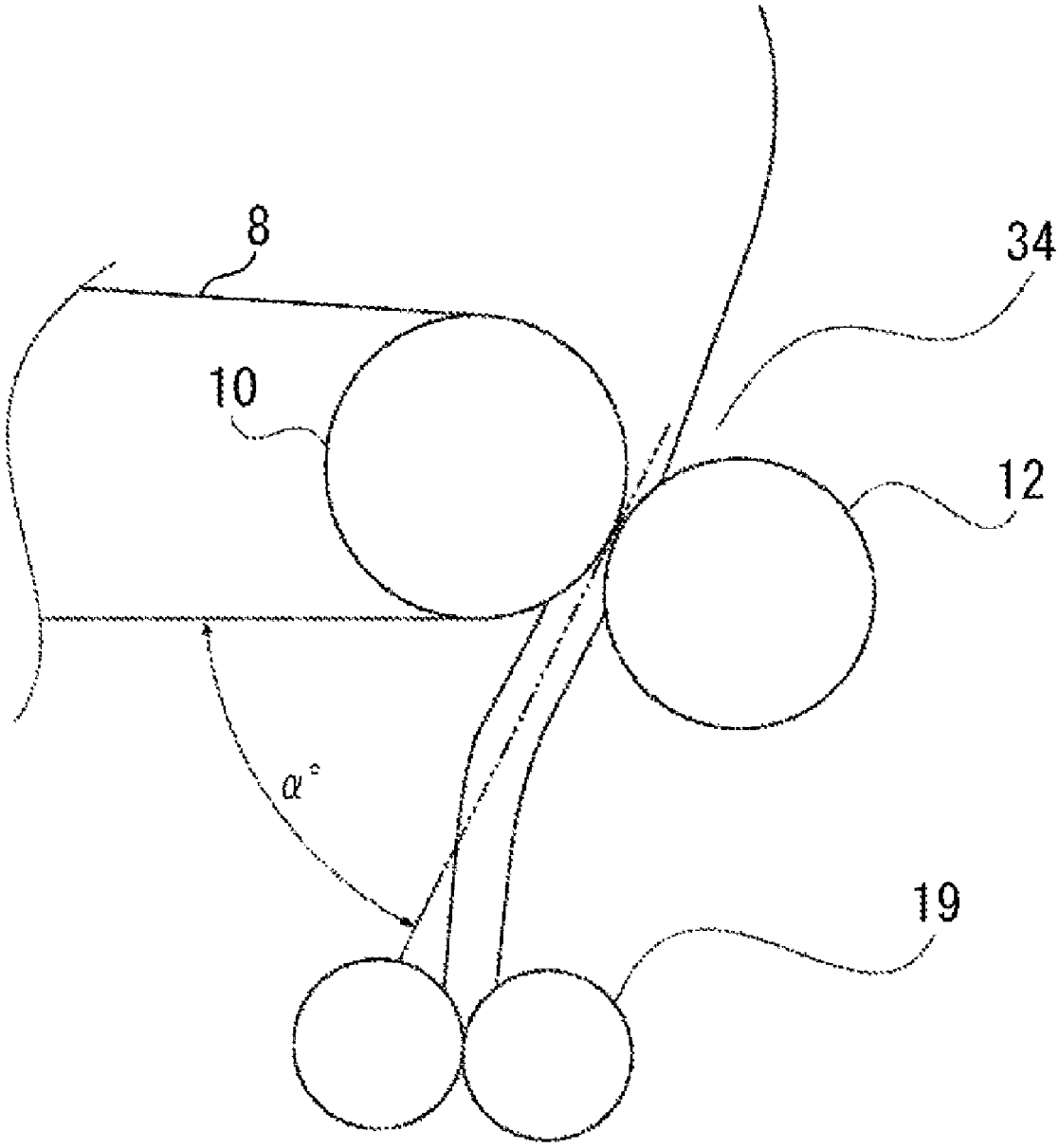
FIG. 4 PRIOR ART
FIG. 4 illustrates an enlarged view of an area around a conventional secondary transfer portion.
Figure 5:
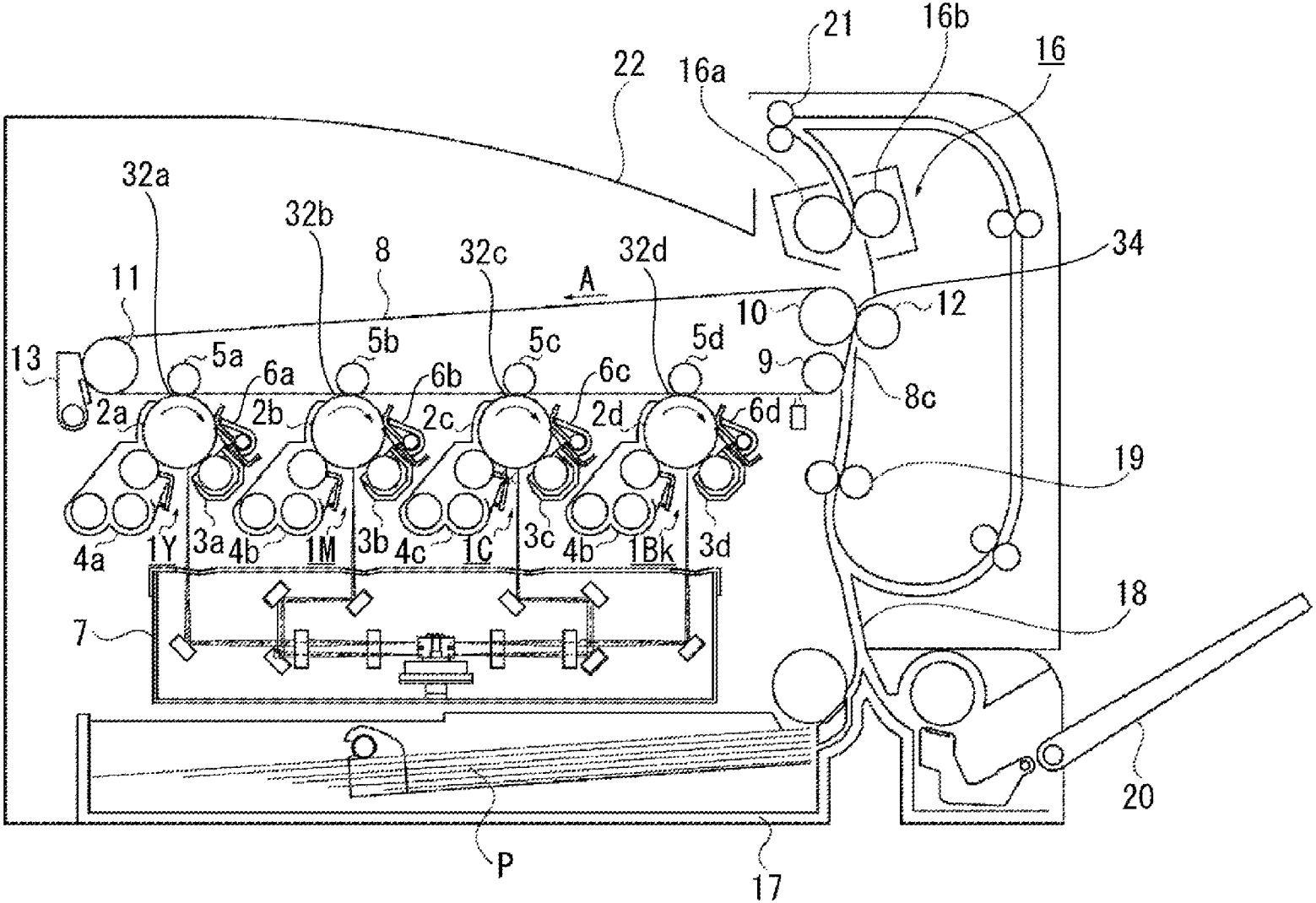
FIG. 5 PRIOR ART
FIG. 5 illustrates a configuration of a conventional image forming apparatus.

FIG. 2 is an enlarged view of an area around the secondary transfer portion 34. The primary transfer plane 8*b* is located at an angle θ to increase the wrapping angle β of the intermediate transfer belt 8 around the driving roller 59, as described above. The angle θ can be set between 10 to 25 degrees. The wrapping angle β of the intermediate transfer belt 8 around the driving roller 59 is set greater than or equal to 90 degrees, or can be set greater than or equal to 120 degrees, in consideration of friction transmission. Consequently, an angle t between the primary transfer plane 8*b* and the secondary transfer plane 8*c* is set smaller than or equal to 90 degrees, or can be set smaller than or equal to 60 degrees. In the present exemplary embodiment, the angle θ at which the primary transfer plane 8*b* is inclined is set at 15 degrees and the wrapping angle β at 100 degrees, so that an angle γ of the secondary transfer plane 8*c* is set at 5 degrees. As described above, the secondary transfer plane 8*c* can be formed approximately vertical relative to the main body of the image forming apparatus. "Approximately vertical" denotes a range in which the transfer material P can be stably conveyed, or a range of ±15 degrees of the angle γ relative to a vertical direction.

Since the form of the transfer material P just after the secondary transfer portion 34 has an effect on an unfixed toner image formed on the transfer material P, the transfer material P is required to be in a stable form. In the present exemplary embodiment, the secondary transfer plane 8*c* is formed in an approximately vertical direction. Consequently, an approximately straight transfer conveyance path from the registration roller 19 to the fixing device 16 via the secondary transfer portion 34 can be formed. As a result, the form of the transfer material P just after the secondary transfer portion 34 can be easily stabilized for transfer materials of various thicknesses, thus leading to high image quality. Moreover, since the conveyance path is approximately straight, a large force does not act on the trailing end of the transfer material P even in a case where the trailing end of a thick transfer material P with high stiffness passes through the secondary transfer portion 34. Therefore, disturbance of an image can be prevented or reduced.

Furthermore, the image forming units (image forming stations) 1Y, 1M, 1C, and 1Bk are disposed at an interval that is equal to an integral multiple of a length obtained by multiplying a sum of the diameter of the driving roller 59 and the thickness of the intermediate transfer belt 8 by π. The reason for such a setting is as follows. A fluctuation of the outer diameter of the driving roller 59 leads to a rotation irregularity of one rotation period in the driving roller 59, and generates a fluctuation in the rotating speed of the intermediate transfer belt 8. The fluctuation in the rotational speed of the intermediate transfer belt 8 (i.e., fluctuation in a moving speed of the primary transfer plane 8*b*) causes color misregistration. That is, a misregistration of the color toner images is generated when the color toner images are superimposed on the intermediate transfer belt 8 by the primary transfer portions 32*a*, 32*b*, 32*c*, and 32*d*.

Such color misregistration can be cancelled by matching the distance that the intermediate transfer belt 8 travels during one rotation of the driving roller 59 with the interval among the primary transfer portions 32*a*, 32*b*, 32*c*, and 32*d*. Therefore, in the present exemplary embodiment, the interval among the image forming units 1Y, 1M, 1C, and 1Bk is set equal to an integral multiple of a length obtained by multiplying a sum of the diameter of the driving roller 59 and the thickness of the intermediate transfer belt 8 by π. As a result, the misregistration of color images (color misregistration), which is generated when the color images are superimposed at the primary transfer portions 32*a*, 32*b*, 32*c*, and 32*d* is not large even when the rotational speed of the intermediate transfer belt 8 fluctuates as described above.

Demands for high productivity and high image quality image forming apparatuses can lead to an increase in the occupied volume of the image forming units 1Y, 1M, 1C, and 1Bk and, thus, an increase in the interval between the image forming units. In such a case, the outside diameter of the driving roller 59 can be increased to achieve the above-described result. Therefore, a high degree of freedom can be realized when making a setting. The interval between the image forming units corresponds to the interval between the center locations of the areas in which the photosensitive drums 2*a*, 2*b*, 2*c*, and 2*d* are in contact with the intermediate transfer belt 8, as viewed in the traveling direction of the intermediate transfer belt 8.

The outside diameters of the secondary transfer counter roller 10 and the driving roller 59 and the interval at which the image forming units 1Y, 1M, 1C, and 1Bk are disposed are specifically summarized below. The outside diameter (or diameter) of the secondary transfer counter roller 10 will be referred to as ϕA, the outside diameter (or diameter) of the driving roller 59 as ϕB, and the interval at which the image forming units 1Y, 1M, 1C, and 1Bk are disposed as L.

The lower limit of ϕA (the outside diameter of the secondary transfer counter roller 10) is defined by the nip width formed between the secondary transfer counter roller 10 and the secondary transfer roller 12 to retain transferability. The lower limit of ϕA is also defined by a maximum curvature for reducing spattering at the time of secondary transfer. Moreover, the upper limit of ϕA is defined by a minimum curvature for preventing the transfer material P from twining around the secondary transfer counter roller 10, as described above.

In consideration of the above conditions, it is useful that the outside diameter ϕA of the secondary transfer counter roller 10 satisfies a condition of 23 mm>ϕA>18 mm. On the other hand, ϕB (the outside diameter of the driving roller 59) is defined by a demand for friction transmission as described above, a pitch between image forming units, and load torque that is determined from inertial force. Therefore, the outside diameter ϕB of the driving roller 59 can satisfy a condition of 34 mm>ϕB>23 mm.

Furthermore, the relationship between ϕB and ϕA is set as ϕB>ϕA.

In the present exemplary embodiment, in particular, ϕA=19.5 mm and ϕB=30.493 mm. In addition, the thickness of the intermediate transfer belt 8 is 65 μm (0.065 mm). Therefore, $L=(30.493+0.065)\times\pi=96.0$ mm.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-344270 filed Dec. 21, 2006, which is hereby incorporated by reference herein in its entirety.

What is claimed is:

1. An image forming apparatus comprising:

a plurality of image forming units, each of the plurality of image forming units having an image carrier;

an image bearing belt configured to carry a toner image transferred from the plurality of the image forming units;

a first roller configured to support the image bearing belt;

a second roller configured to transmit driving force to the image bearing belt while supporting the image bearing belt;

a third roller located above the second roller in a vertical direction of the image forming apparatus and configured to support the image bearing belt; and a transfer roller configured to press the third roller and to form a transfer portion for electrostatically transferring the toner image on the image bearing belt onto the conveyed recording material, wherein the plurality of image forming units are located opposing the surface of the image bearing belt between the first roller and the second roller, wherein the first roller is located at a higher place than the third roller, the surface of the image bearing belt to extend around the second roller and the third roller is located at an angle within a range of ±15° in the vertical direction of the image forming apparatus, and a diameter of the second roller is larger than a diameter of the third roller.

2. The image forming apparatus according to claim 1, wherein a diameter ($\phi A$) of the third roller and a diameter ($\phi B$) of the second roller satisfy the following conditions:

23 mm>$\phi A$>18 mm, and 34 mm>$\phi B$>23 mm.

3. The image forming apparatus according to claim 1, further comprising a fixing unit configured to fix the toner image on the recording material, the fixing unit being located at a higher place than the transfer unit in the vertical direction of the image forming apparatus.

4. The image forming apparatus according to claim 1, wherein an interval between a center location of an area in which the image carrier of a first image forming unit is in contact with the image bearing belt and a center location of an area in which the image carrier of a second image forming unit is in contact with the image bearing belt is an integral multiple of a circumferential length of the second roller.

* * * * *